US005704302A

United States Patent [19]

Tseng

[11] Patent Number: 5,704,302

[45] Date of Patent: Jan. 6, 1998

[54] LOOPER DEVICE HAVING A THREAD FEEDING MECHANISM

[76] Inventor: Hsien Chang Tseng, 9F., No. 13-4, Sec. 1, Da Ching Street, Taichung, Taiwan

[21] Appl. No.: 719,429

[22] Filed: Sep. 25, 1996

[51] Int. Cl.[6] ..... D05B 1/20; D05B 61/00

[52] U.S. Cl. ..... 112/162; 112/199; 112/302

[58] Field of Search ..... 112/162, 168, 112/199, 302, 475.26, 197, 200, 166

[56] References Cited

U.S. PATENT DOCUMENTS 4,942,834 7/1990 Kitai ..... 112/199

4,942,835 7/1990 Oguri ..... 112/302

5,237,942 8/1993 Satoma ..... 112/199 X

*Primary Examiner*—Peter Nerbun

*Attorney, Agent, or Firm*—Charles E. Baxley, Esq.

[57] ABSTRACT

A looper device includes a rod slidably supported in a sewing machine and allowed to move up and down. A looper is secured on the upper end of the rod and includes a hole formed in the front end and includes a support formed on the rear portion. A lever is coupled to the support at a pivot shaft and includes an extension extended from the front end for engaging with the front end of the looper and forming a shoulder which may engage with and may feed a thread upward. The lever includes a member for positioning the lever relative to the looper.

3 Claims, 2 Drawing Sheets

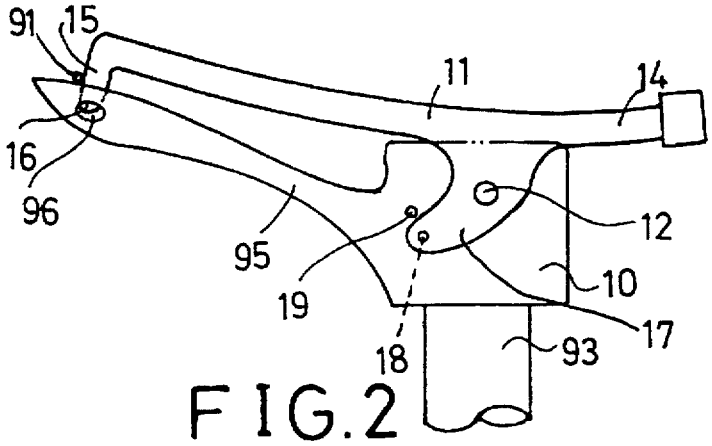
FIG.2
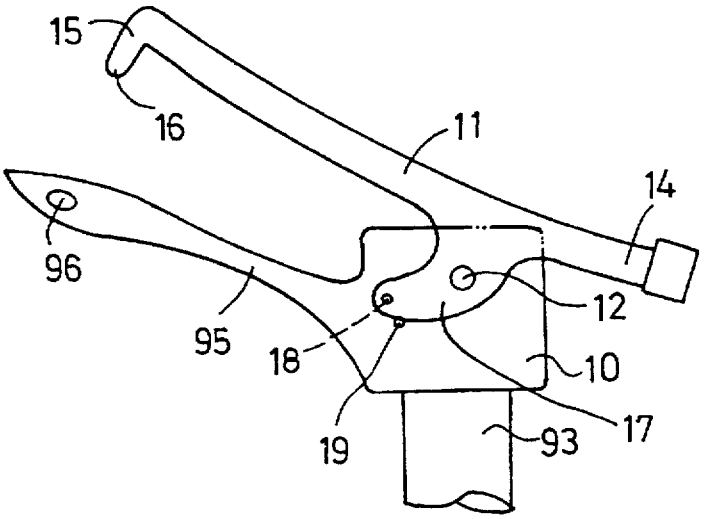
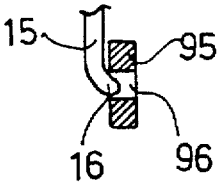
FIG.4
FIG.3
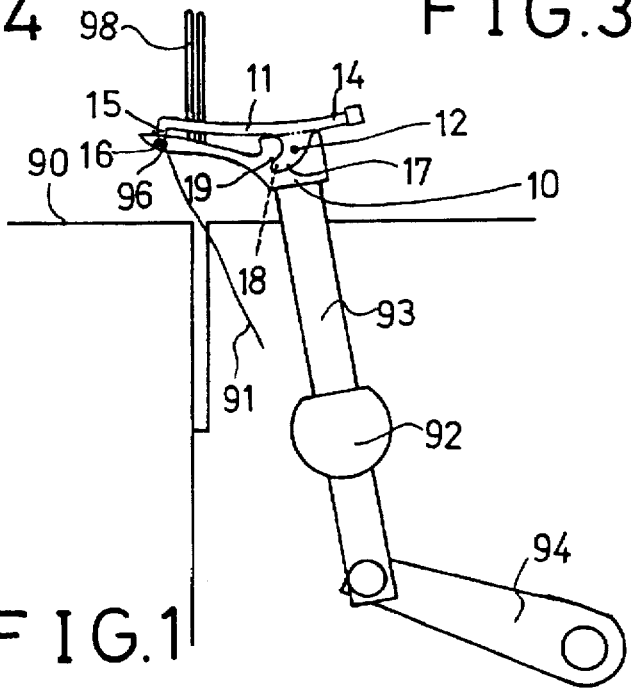
FIG.1

LOOPER DEVICE HAVING A THREAD FEEDING MECHANISM

BACKGROUND OF THE INVENTION

1. Field of the Invention

The present invention relates to a looper device of a sewing machine, and more particularly to a looper device having a thread feeding mechanism.

2. Description of the Prior Art

A typical looper device for a sewing machine, particularly an overlock sewing machine, is shown in FIGS. 5 and 6 and comprises a rotary support 92 rotatably secured to the Sewing machine 90 for slidably supporting a rod 93 and for allowing the rod 93 to be moved up and down. The rod 93 includes a looper 95 secured on top thereof and having a hole 96 for engaging with a thread. A link 94 couples the rod 93 to a driving shaft for moving the rod 93 up and down and for moving the looper 95 downward (FIG. 6) and upward (FIG. 5). The thread carried by the looper 95 may co-act with that carried by the needles 98 so as to conduct stitching operations. However, when the looper 95 moves upward above the working table and the needle plate of the sewing machine 90, another thread 91 may move downward to the root portion of the looper 95 (FIG. 5) such that the thread 91 may not be used for a stitching operation. However, in some of special stitching operations, the thread 91 is also required to be fed upward above the working table for conducting a stitching operation. The typical looper device may not be used for feeding the thread 91 upward above the working table.

The present invention has arisen to mitigate and/or obviate the afore-described disadvantages of the conventional loopers for sewing machines.

SUMMARY OF THE INVENTION

The primary objective of the present invention is to provide a looper device having a thread feeding mechanism for feeding the thread upward above the working table and the needle plate of the sewing machine.

In accordance with one aspect of the invention, there is provided a looper device for a sewing machine, the looper device comprises a rod slidably supported in the sewing machine and being allowed to move up and down, the rod including an upper end, a looper secured on the upper end of the rod and moved up and down in concert with the rod, the looper including a front end having a hole formed therein and including a rear portion having a support provided thereon, and a lever pivotally coupled to the support at a pivot shaft for allowing the lever to be rotated about the pivot shaft between an open position and an enclosed position, the lever including a front end having an extension extended therefrom for engaging with the front end of the looper, the extension and the front end of the looper forming a shoulder for engaging with a thread and for feeding the thread upward when the lever is moved to and located at the enclosed position, and the extension being disengaged from the front end of the looper for allowing the thread to move to the rear portion of the looper when the lever is located at the open position.

The lever includes a rear portion having a handle provided thereon for operating the lever.

The extension of the lever includes a bottom portion having a hook laterally extended therefrom for engaging with the hole.

The support includes two first engaging members provided thereon, the lever includes a leg extended therefrom, the leg includes a second engaging member for engaging with the first engaging members of the support and for positioning the lever at the open position and the enclosed position respectively.

Further objectives and advantages of the present invention will become apparent from a careful reading of a detailed description provided hereinbelow, with appropriate reference to accompanying drawings.

BRIEF DESCRIPTION OF THE DRAWINGS

FIG. 1 is a plane view illustrating an operation of a looper device in accordance with the present invention;

FIGS. 2 and 3 are enlarged plane views illustrating the operation of the looper device;

FIG. 4 is a cross sectional view taken along lines 4—4 of FIG. 2.

DETAILED DESCRIPTION OF THE PREFERRED EMBODIMENT

Figure 5:
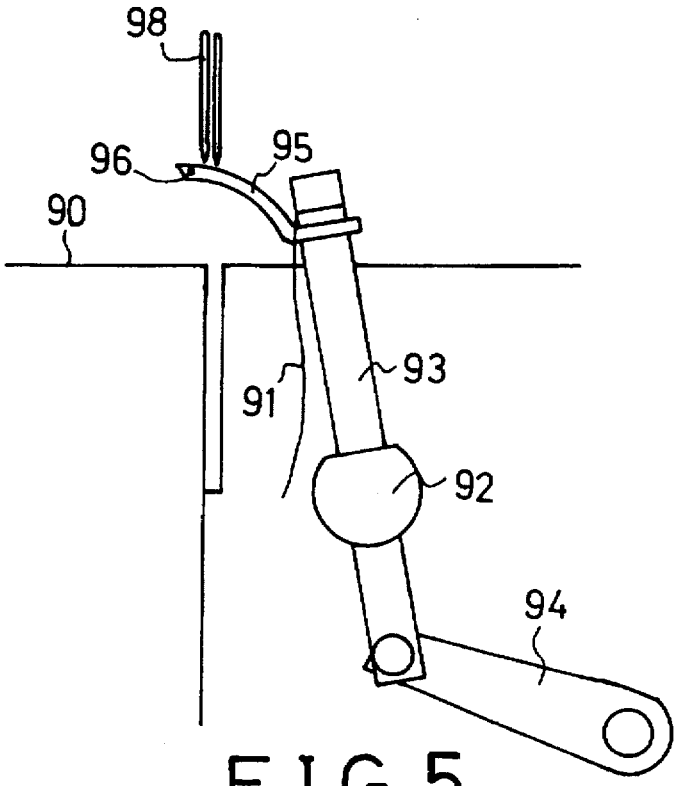
FIG. 5 PRIOR ART
FIGS. 5 and 6 are plane views illustrating the operation of the typical looper device.
Figure 6:
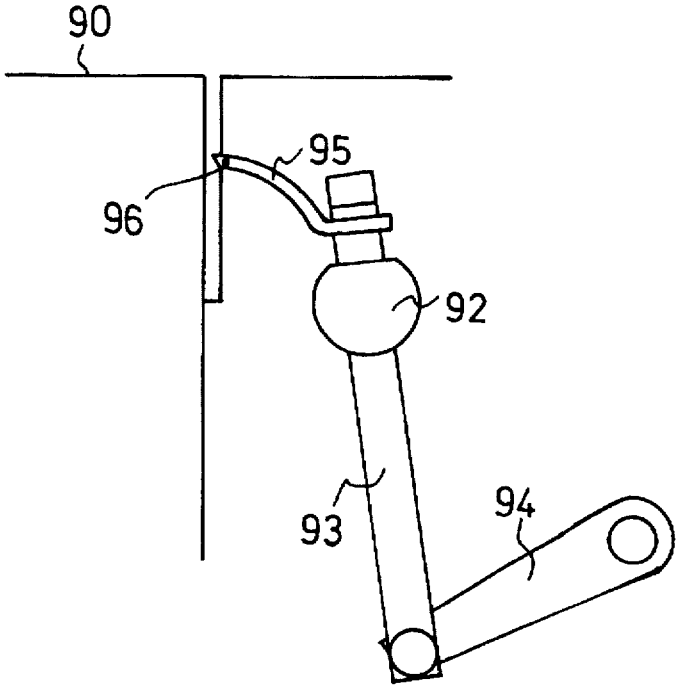
FIG. 6 PRIOR ART

Referring to the drawings, and initially to FIGS. 1 and 2, a looper device in accordance with the present invention is provided in a sewing machine which comprises a rotary support 92 rotatably secured to the sewing machine 90 for slidably supporting a rod 93 and for allowing the rod 93 to be moved up and down. The rod 93 includes a looper 95 secured on top thereof and having a hole 96 formed in the front end for engaging with a thread (not shown). A link 94 couples the rod 93 to a driving shaft for moving the rod 93 up and down and for moving the looper 95 downward and upward. The thread carried by the looper 95 may co-act with that carried by the needles 98 so as to conduct stitching operations when the looper 95 is moved upward above the working table and the needle plate of the sewing machine 90.

The looper 95 includes a rear portion having a support 10 provided thereon. A lever 11 is pivotally coupled to the support 10 at a pivot shaft 12 and at the middle portion thereof. The lever 11 includes a handle 14 provided on the rear portion thereof for operating the lever 11. The lever 11 includes an extension 15 extended downward therefrom for engaging with the front end of the looper 95 so as to form a shoulder for carrying a thread 91 and for feeding the thread 91 upward above the needle plate of the sewing machine. It is preferable that the extension 15 includes a hook 16 laterally extended from the bottom portion for engaging with the hole 96 of the looper 95 (FIG. 4) and for preventing the thread 91 from slipping through the gap formed between the extension 15 and the looper 95. It is also preferable that the lever 11 includes a leg 17 extended downward from the middle portion. The leg 17 includes a depression or a projection 18 for engaging with either of two corresponding projections or depressions 19 so as to position the lever 11 at an open position (FIG. 3) or at an enclosed position (FIG. 2).

It is to be noted that the most important thing is that the lever 11 is pivotally coupled to the support 10 such that the lever 11 will not be easily disengaged from the looper 95 and such that the lever 11 may be easily supported in place. The handle 14 is a selective option for facilitating the operation of the lever 11. The positioning engagement between the projection and depression 18, 19 may also be replaced by applying a frictional force to the contact surfaces between the lever 11 and the support 10.

It is preferable that the hook 16 of the extension 15 is engaged into the hole 96 of the looper 95 for allowing the extension 45 and the front end of the looper 95 to stably formed the shoulder and to stably engage with and feed the thread 91.

Accordingly, the looper device in accordance with the present invention includes a thread feeding mechanism for feeding the thread upward above the working table and the needle plate of the sewing machine.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A looper device for a sewing machine, said looper device comprising:

a rod slidably supported in the sewing machine and being allowed to move up and down, said rod including an upper end, a looper secured on said upper end of said rod and moved up and down in concert with said rod, said looper including a front end having a hole formed therein and including a rear portion having a support provided thereon, and a lever pivotally coupled to said support at a pivot shaft for allowing said lever to be rotated about said pivot shaft between an open position and an enclosed position, said lever including a front end having an extension extended therefrom for engaging with said front end of said looper, said extension of said lever including a bottom portion having a hook laterally extended therefrom for engaging with said hole of said looper, said extension and said front end of said looper forming a shoulder for engaging with a thread and for feeding the thread upward when said lever is moved to and located at the enclosed position, and said extension being disengaged from said front end of said looper for allowing the thread to move to the rear portion of said looper when said lever is located at the open position.

2. A looper device according to claim 1, wherein said lever includes a rear portion having a handle provided thereon for operating said lever.

3. A looper device according to claim 1, wherein said support includes two first engaging members provided thereon, said lever includes a leg extended therefrom, said leg includes a second engaging member for engaging with said first engaging members of said support and for positioning said lever at the open position and the enclosed position respectively.

* * * * *